United States Patent [19]
Panchanathan et al.
[11] 4,404,028
[45] Sep. 13, 1983

[54] NICKEL BASE ALLOYS WHICH CONTAIN BORON AND HAVE BEEN PROCESSED BY RAPID SOLIDIFICATION PROCESS

[75] Inventors: Viswanathan Panchanathan, Billerica; Ranjan Ray, Waltham; Bill C. Giessen, Cambridge, all of Mass.

[73] Assignee: Marko Materials, Inc., Billerica, Mass.

[21] Appl. No.: 257,778

[22] Filed: Apr. 27, 1981

[51] Int. Cl.[3] ..... C22C 19/08
[52] U.S. Cl. ..... 75/244; 75/0.5 R; 148/409; 148/410; 419/12; 419/48; 420/457; 420/458
[58] Field of Search ..... 75/170, 171, 230, 244, 75/201, 202, 0.5 R; 148/32, 32.5, 126, 162

[56] References Cited

U.S. PATENT DOCUMENTS 4,297,135 10/1981 Giessen et al. ..... 75/171

*Primary Examiner*—R. Dean
*Attorney, Agent, or Firm*—Morse, Altman & Dacey

[57] ABSTRACT

New nickel rich metal alloys containing copper along with specific amounts of boron are disclosed. The alloys are subjected to rapid solidification processing (RSP) techniques which produce cooling rates between $\sim 10^{5°}$ to $10^{7°}$ C./sec. The as-quenched ribbon, powder, etc. consists primarily of a metastable crystalline solid solution phase. The metastable crystalline phases are subjected to suitable heat treatments so as to produce a transformation to a stable multiphase microstructure which includes borides. This heat treated alloy exhibits superior mechanical properties with good corrosion and/or oxidation resistance for numerous engineering applications.

3 Claims, No Drawings

NICKEL BASE ALLOYS WHICH CONTAIN BORON AND HAVE BEEN PROCESSED BY RAPID SOLIDIFICATION PROCESS

BACKGROUND OF THE INVENTION

1. Field of the Invention

This invention relates generally to rapidly solidified nickel-rich alloys obtained by adding small amounts of boron. This invention also relates to the preparation of these materials in the form of rapidly solidified powder and consolidation of these powders (or alternatively, the rapidly solidified ribbon-like material) into bulk parts which are suitably heat treated to have desirable properties. This invention also relates to the preferred nickel-rich metal alloy compositions made by this method.

2. Description of the Prior Art

Rapid solidification processing (RSP) techniques offer outstanding prospects of new cost effective engineering materials with superior properties [See Proc. Int. Conf. on Rapid Solidification Processing; Reston, Va., 1980; Published by Claitors Publishing Division, Baton Rouge, La. ]Metallic glasses, microcrystalline alloys, supersaturated solid solutions and ultra-fine grained alloys with highly refined microstructures, in each case often having complete chemical homogenity, are some of the products that can be made by utilizing RSP. (See Rapidly Quenched Metals, 3rd, Int. Conf. Vol. 1 and 2, Cantor Ed; the Metals Society, London, 1978).

Several techniques are well established in the state of the art to economically fabricate rapidly solidified alloys (at cooling rates of $\sim 10^5$ to $10^7$ °C./sec) as ribbons, filaments, wire, flakes or powders in large quantities. One well known example is melt spin chill casting whereby the metal is spread as a thin layer on a conductive metallic substrate moving at high speed to form rapidly solidified ribbon (see Proc. Int. Conf. on Rapid Solidification Processing, Reston, Va., Nov. 1977).

The current technological interest in materials produced by RSP, especially when followed by consolidation into bulk parts may be traced in part to the problems associated with micro and macro segregation and undesirable massive grain boundary eutectic phases that occur in highly alloyed materials during conventional slow cooling processes i.e. ingot or mold casting. RSP removes macrosegregation altogether and significantly reduces spacing over which micro-segregation occurs, if it occurs at all.

The design of alloys made by conventional slow cooling processes is largely influenced by the corresponding equilibrium phase diagrams which indicate the existence and co-existence of the phases present in thermodynamic equilibrium. Alloys prepared by such processes are in or at least near equilibrium. The advent of rapid quenching from the melt has enabled material scientists to stray further from the state of equilibrium and has greatly widened the range of new alloys with unique structures and properties available for technological applications.

Many nickel base alloys are used for chemical and marine parts where corrosion resistance and white color are important.

Nickel base alloys containing essentially about 30 wt% cooper which are commercially known as Monel are widely used in a variety of applications. The alloy may be cast, rolled or forged and can be annealed after cold working. It is resistant to corrosion and to the action of many acids and will retain its bright nickel white surface under ordinary conditions. (See Materials Handbook, George S. Brady and Henry R. Clauser, p. 499, Published by McGraw-Hill Book Co., 1977).

There have been limited efforts as reported in the prior art involving the use of rapid solidification processing techniques to synthesize new and improved nickel base alloys. A need therefore exists to develop new nickel base alloys with unique chemical compositions and structures exhibiting superior mechanical properties, and corrosion and/or oxidation resistance for numerous industrial applications.

SUMMARY OF THE INVENTION

This invention features a class of nickel base alloys having excellent corrosion and oxidation resistance combined with high hardness and strength when the production of these alloys includes a rapid solidification process. These alloys can be described by the following composition, $Ni_a Cu_b Al_c M_d Si_e B_f$-[A] wherein Ni, Cu, Al, Si and B respectively represent nickel copper, aluminum, silicon and boron; M is one or more of the metals Iron (Fe), Cobalt (Co), Vanadium (V), Mangasese (Mn) and Chromium (Cr), a, b, c, d, e and f represent atom percent of Ni, Cu, Al, M, Si and B, respectively, and have the following values a=40–80, b=10–40, c=0–15, d=0–10, e=0–5 and f=5–15 with the provisos that, (1) the sum of (b+c+d) may not exceed 50, (2) the sum of (e+f) may not exceed 15, and, (3) the sum of (a+b+c+d+e+f) is 100. All compositions set forth herein are in atom percent unless otherwise specified.

Rapid solidification processing (RSP) [i.e. processing in which the liquid alloy is subjected to cooling rates of the order of $10^5$ to $10^7$°C./sec] of such boron-containing alloys produced a metastable crystalline structure which is chemically homogeneous and can be heat treated and/or thermomechanically processed so as to form a fine dispersion of borides and/or silicides which strengthen the alloy as well as other intermetallics. The heat treated and/or thermomechanically processed material is harder and stronger than conventional alloys while exhibiting excellent corrosion and oxidation resistance. The inclusion of boron in the alloy has several advantages. It enhances the supercooling of the liquid which is achievable and makes easier the formation of a chemically homogeneous, metastable crystalline product when a RSP is used. The fine borides and/or silicides formed in RSP alloy after heat treatment strengthen the metal and enhance microstructural stability and strength. The inclusion of boron makes it possible to obtain a good yield of uniform material from melt spinning which is an economical RSP. The as-quenched melt spun ribbons are brittle and can be readily ground to a powder, a form especially suitable for consolidation into a transformed (ductile) final product.

The melt spin method includes any of the processes such as single roll chill block casting, double roll quenching, melt extraction, melt drag, etc., where a thin layer of liquid metal is brought in contact with a solid substrate.

DETAILED DESCRIPTION OF THE PREFERRED EMBODIMENTS

In accordance with the present invention, nickel base alloys containing 10 to 40% of copper are further alloyed with 5 to 15% of boron. These alloys are optionally alloyed with one or more of the following elements: 0–15% of Al, 0–5% of Si, and 0–10% of Fe, Co, V, Mn, and Cr as single or combined. The alloys may also contain limited amounts of other elements which are commercially found in nickel base alloys without changing the essential behavior of the alloys. Typical examples include: $Ni_{55}Cu_{33}B_{12}$, $Ni_{65}Cu_{20}Si_4Fe_5B_6$, $Ni_{45}Cu_{30}Al_{13}Mn_2B_{10}$, $Ni_{75}Cu_{12}B_{13}$, $Ni_{60}Cu_{20}Al_{10}Si_5B_5$, $Ni_{60}Cu_{20}V_2Cr_5Co_2B_9Si_2$, $Ni_{50}Cu_{30}Fe_5Cr_5B_{10}$, and $Ni_{55}Cu_{25}V_5Co_5B_{10}$.

The alloys of the present invention upon rapid solidification processing from the melt by melt spin chill casting at cooling rates of the order of $10^5$ to $10^7$ °C./sec form brittle ribbons consisting predominantly of solid solution phase with a high degree of compositional uniformity. The brittle ribbons are readily pulverised into a powder or staple configuration using standard comminution techniques. The powder or staple is consolidated into bulk parts using standard powder metallurgical techniques optionally followed by heat treatments for optimised properties. The bulk alloys contain finely dispersed intermetallic compounds and borides and/or silicides within the conventional nickel-rich matrix, such material being ductile and having high hardness and strength compared to commercial nickel-copper alloys.

When the alloys within the scope of the present invention are solidified by conventional slow cooling processes, they inherit highly segregated microstructures with large compositional non-uniformity and large eutectic network of brittle boride phases and hence exhibit poor mechanical properties. In contrast, when the above alloys are made using RSP techniques followed by heat treatment at high temperatures, preferably between 750° to 950° C. for 0.1 to 100 hrs., the precipitation of ultrafine complex metallic borides, such as MB, $M_2B$, $M_6B$ etc., takes place where M is one or more of the metals in the alloys, the boride particles with average particle size of ~0.5 micron, preferably 0.05 micron, being finely dispersed both intergranularly and intragranularly.

Typically, the matrix grains have a size less than 10 microns, preferably less than 2 microns. The high temperature heat treatment necessary to generate the above described microstructures of the alloys of the present invention can be a separate annealing treatment or can occur along with the consolidation step. Consolidation can also be achieved by hot mechanical deformation at high strain rates whereby finer boride particles will precipitate out in the matrix.

The fully heat treated RSP alloys of the present invention exhibit high strength and high hardness combined with good ductility as compared to commercially known nickel-copper alloys. The alloys of the present invention typically have hardness values of 160 to 500 $Kg/mm^2$ and tensile strengths of 65 to 260 Ksi. As a comparison, the commercial Monel alloy has got maximum tensile strength of 160 Ksi in fully heat treated condition.

The invention discloses the preparation of rapidly solidified powders of the present boron-containing nickel-rich alloys by melt spinning brittle ribbons followed by mechanical pulverisation of ribbons. Other known rapidly solidified powder processing methods, such as forced convective cooling of atomized droplets, known in the art, can be used to make rapidly solidified powders of the present alloys and such powders can be subsequently powder metallurgically consolidated into bulk parts and/or heat treated for optimised microstructures, mechanical properties and corrosion and oxidation resistance.

The powders of the present alloys obtained from RSP, either made from the melt or the filaments can be consolidated into bulks parts i.e., bars, rods, plates, discs, etc. by various known metallurgical processing techniques such as hot extrusion, hot forging, hot isostatic pressing, hot rolling, cold pressing followed by sintering etc.

While any of the wide variety of RSP techniques can be employed in the practice of this invention, the combination of melt spinning and subsequent pulverisation is preferred. The quench rate experienced by the melt is much more uniform in the melt spinning process than for e.g. atomization processes. In atomization, the quench rate and hence the metastable structure and the final heat treated structure derived therefrom varies greatly with the particle size. Screening out the larger particles formed from atomization gives material which has been subjected to a more uniform quench. However, the yield is reduced making the process less economical. In contrast, the powders made from pulverised ribbons have experienced the same quench history. The melt spinning procedure can be practiced with the present alloys so as to have a high yield (e.g. >95%) of relatively fine powder (e.g. −100 mesh). Alternatively, the rapidly solidified filaments as formed or after partial fragmentation can be consolidated directly into bulk parts without the step necessary to form an intermediate powder.

The boron content of the present alloys in the range 5 to 15 atom percent is critical. When boron content is less than 5 atom percent the nickel base alloys are difficult to form as rapidly solidified brittle ribbons by the method of melt deposition on a rotating chill substrate (i.e.) melt spinning. This is due to the inability of the boron-lean alloy melts to form a stable molten pool on the quench surface. Furthermore, at very low boron content the alloys have less desirable mechanical properties in the heat treated condition because of having insufficient amounts of the strengthening borides that can be formed by the heat treatment. Thus, more than 5 atom percent boron is desirable.

When the boron content is high, (i.e.) >15 atom percent, the heat treated alloys exhibit poor mechanical properties due to excessive amounts of hard and brittle boride particles in the microstructure. Thus, not more than 15 atom percent boron is desirable.

The rapidly solidified brittle ribbons made by melt spinning can be mechanically comminuted into powders having particle size less than 100 U.S. mesh using standard equipment such as hammer mill, ball mill, fluid energy mill and the like.

The physical properties of the heat treated alloys depend on alloy compositions and the heat treatment cycles employed. Thus, a specific property can be optimised by identifying those alloying elements and the degree of alloying which optimise that property. Of particular interest in these alloys are increased strength and hardness and improved oxidation and corrosion resistance.

The alloys of the system Ni-Cu-B with boron contents 12 to 15%, prepared in accordance with the present invention, belong to a preferred group of alloys. These alloys are described by the formula $Ni_{45-78}Cu_{10-40}B_{12-15}$. Examples include $Ni_{50}Cu_{38}B_{12}$, $Ni_{60}Cu_{25}B_{15}$, $Ni_{70}Cu_{16}B_{14}$, $Ni_{78}Cu_{10}B_{12}$ and $Ni_{65}Cu_{23}B_{12}$. The above alloys upon rapid quenching by melt spinning form extremely brittle ribbons consisting of single solid solution phase. The quenched alloys may additionally contain borides dispersed in the matrix. Upon heat treatment between 800° to 950° C. for 1 to 3 hours precipitation of ultrafine complex borides takes place both intragranularly and intergranularly. After such heat treatment the above described Ni-Cu-B alloys become ductile and possess high hardness values between 300 to 385 Kg/mm$^2$.

Another preferred class of alloys is based on the addition of aluminum and/or silicon to Ni-Cu-B alloy. This class is defined by the general formula $Ni_{40-80}Cu_{10-40}Al_{0-15}Si_{0-5}B_{5-10}$. Examples include $Ni_{40}Cu_{30}Al_{15}Si_5B_{10}$, $Ni_{60}Cu_{20}Al_5Si_5B_{10}$, $Ni_{70}Cu_{16}Si_4B_{10}$, $Ni_{60}Cu_{20}Al_{10}B_{10}$ and $Ni_{50}Cu_{38}Si_4B_8$.

The ribbons obtained by melt spinning are brittle which upon heat treatment above 750° C. becomes brittle and hard with typical hardness values ranging between 160 to 480 Kg/mm$^2$.

For the above alloys the dominant mechanism of strengthening is dispersion hardening. To achieve the most effective dispersion hardening, the boride particles must be very small and the distribution must be uniform.

All the above alloys described as preferred class exhibit good atmospheric corrosion resistance when exposed in an indoor as well as an outdoor environment. They exhibit similar corrosion resistance like conventional Ni-Cu alloys while possessing significantly superior mechanical properties. Also, alloys containing aluminum and silicon were resistant to corrosion in 5 wt% sodium chloride solution and also had good oxidation resistance.

EXAMPLES 1 to 5

Selected nickel-copper alloys were alloyed with boron contents ranging from 12 to 15%. Some typical compositions are given in Table 1. These boron-containing alloys were melt spun into ribbons having thicknesses of 25 to 75 microns thick by the RSP technique of melt spinning using a rotation Cu-Be cylinder having a quench surface speed of ~5000 ft/min. The ribbons were found by X-ray diffraction analysis to consist predominantly of a single solid solution phase. Ductility of the ribbons was measured by the bend test. The ribbon was bent to form a loop and the diameter of the loop was gradually reduced until the loop was fractured. The breaking diameter of the loop is a measure of ductility. The larger the breaking diameter for a given ribbon thickness, the more brittle the ribbon is considered to be (i.e.) the less ductile. The as-quenched ribbons were all found to have breaking diameters of ~0.1 inch and thus are quite brittle. The ribbons were heat treated at 800° to 950° C. for 2 hours and then air cooled to room temperature. The ribbons were found to be fully ductile. A ribbon which bends back onto itself without breaking has deformed plastically into a "V" shape and is labelled fully ductile. The hardness values of these ribbons ranged between 300 to 385 Kg/mm$^2$.

TABLE 1

| Example | Alloy Composition (atom percent) | Hardness Kg/mm$^2$ |
|---|---|---|
| 1 | $Ni_{50}Cu_{38}B_{12}$ | 385 |
| 2 | $Ni_{60}Cu_{28}B_{12}$ | 312 |
| 3 | $Ni_{70}Cu_{18}B_{12}$ | 335 |
| 4 | $Ni_{50}Cu_{36}B_{14}$ | 360 |
| 5 | $Ni_{70}Cu_{16}B_{14}$ | 365 |

EXAMPLES 6 to 11

Several nickel-copper alloys containing aluminum and silicon either alone or together along with boron were prepared as RSP ribbons on 50–100 gms quantity in accordance with the present invention. Some typical compositions are given in Table 2. The as-cast ribbons were found to be brittle to bending and were readily pulverised into powders under 100 mesh using a commercial rotating hammer mill. The-as quenched ribbons of the above alloys upon heat treatment at 800° C. for 2 hrs. were found to become fully ductile to 180° bending. The heat treated ribbons exhibited hardness values between 160 and 480 Kg/mm$^2$.

TABLE 2

| Example | Alloy Composition (atom percent) | Hardness Kg/mm$^2$ |
|---|---|---|
| 6 | $Ni_{50}Cu_{40}B_6Si_4$ | 412 |
| 7 | $Ni_{60}Cu_{28}B_8Si_4$ | 350 |
| 8 | $Ni_{70}Cu_{18}B_8Si_4$ | 380 |
| 9 | $Ni_{60}Cu_{30}B_6Si_4$ | 160 |
| 10 | $Ni_{55}Cu_{25}Al_{10}B_{10}$ | 303 |
| 11 | $Ni_{60}Cu_{22}Al_8Si_5B_5$ | 480 |

EXAMPLES 12 to 17

The following alloys (refer to Table 3) were exposed in an indoor atmospheric environment for 1000 hours. All the alloys were found to exhibit excellent resistance to indoor atmospheric corrosion, (i.e.) the alloys showed no sign of discoloration or tarnish.

TABLE 3

| Example | Alloy Composition (atom percent) |
|---|---|
| 12 | $Ni_{50}Cu_{38}B_{12}$ |
| 13 | $Ni_{50}Cu_{36}B_{14}$ |
| 14 | $Ni_{60}Cu_{28}B_8Si_4$ |
| 15 | $Ni_{50}Cu_{40}B_6Si_4$ |
| 16 | $Ni_{55}Cu_{25}Al_{10}B_{10}$ |
| 17 | $Ni_{60}Cu_{22}Al_8Si_5B_5$ |

EXAMPLES 18 to 23

Alloys given in Table 4 were exposed to an outdoor atmospheric environment for 1000 hours. The alloys were found to show excellent resistance to outdoor atmospheric corrosion (i.e.) the alloys showed no sign of discoloration or tarnish.

TABLE 4

| Example | Alloy Composition (atom percent) |
|---|---|
| 18 | $Ni_{50}Cu_{38}B_{12}$ |
| 19 | $Ni_{50}Cu_{36}B_{14}$ |
| 20 | $Ni_{60}Cu_{28}B_8Si_4$ |
| 21 | $Ni_{50}Cu_{40}B_6Si_4$ |
| 22 | $Ni_{55}Cu_{25}Al_{10}B_{10}$ |
| 23 | $Ni_{60}Cu_{22}Al_8Si_5B_5$ |

EXAMPLE 24

The following alloy (Table 5) was exposed at a temperature of 750° C. for 16 hours. It did not show any trace of oxidation as evidenced by the lack of oxide scale formation.

TABLE 5

| Example | Alloy Composition (atom percent) |
|---|---|
| 24 | $Ni_{60}Cu_{22}Al_8Si_5B_5$ |

EXAMPLE 25

The following alloy (Table 6) was exposed at a temperature of 750° C. for 2 hours. It did not show any trace of oxidation as evidenced by the lack of oxide scale formation.

TABLE 6

| Example | Alloy Composition (atom percent) |
|---|---|
| 25 | $Ni_{55}Cu_{25}Al_{10}B_{10}$ |

EXAMPLE 26

Alloy of composition given in Table 7 was kept in 5 wt% sodium chloride solution for 120 hours. It did not show any corrosion as evidenced by the clear surface.

TABLE 7

| Example | Alloy Composition (atom percent) |
|---|---|
| 26 | $Ni_{60}Cu_{22}Al_8Si_5B_5$ |

EXAMPLE 27

The following example illustrates an economical method of continuous production of RSP powder of the boron-modified nickel base alloys of the composition indicated in (A) with the present invention.

The nickel base alloys containing boron are melted in any of the standard melting furnaces. The melt is transferred via a ladle onto a tundish having a series of orifices. A multiple number of jets are allowed to impinge on a rotating water cooled copper-beryllium drum whereby the melt is rapidly solidified as ribbons. The as-cast brittle ribbons are directly fed into a hammer mill of appropriate capacity wherein the ribbons are ground into powders of desirable size ranges.

Having thus described the invention, what we claim and desire to obtain by Letters of the United States is:

1. Fine grained nickel-base alloys containing dispersed borides in bulk form having composition $Ni_aCu_bAl_cM_dSi_eB_f$ wherein M is at least one element selected from the group consisting of Fe, Co, Vn Mn and Cr, and the subscripts represent atom percent having the values a=40–79, b=16–40, c=0–15, d=0–10, e=0–5, and f=5–15, with the provisos that the sum of b+c+d may not exceed 50 atom percent, the sum of e+f may not exceed 15 atom percent and the sum of a+b+c+d+e+f is 100, made by subjecting the powders of the said alloys to application of pressure and heat, said powders being made by the method comprising the following steps:

(a) forming a melt of said alloy (b) depositing said melt against a rapidly moving quench surface adapted to quench said melt at a rate in the range of approximately $10^5$ to $10^7$ °C./second and form thereby a rapidly solidified brittle strip of said alloys characterized by predominantly a metastable single solid solution structure, (c) comminuting said strip into powders.

2. The alloy of claim 1 having the composition $Ni_{45-72}Cu_{16-40}B_{12-15}$.

3. The alloys of claim 1 having the composition $Ni_{40-79}Cu_{16-40}Al_{5-15}Si_{0-5}B_{5-10}$ with the provisos that the sum of atom percent of Ni, Cu, Al, Si, and B is 100.

* * * * *